US008980166B2

(12) United States Patent
Heinzel et al.

(10) Patent No.: US 8,980,166 B2
(45) Date of Patent: Mar. 17, 2015

(54) METHOD FOR PRODUCING A SEMIFINISHED PRODUCT AND SEMIFINISHED PRODUCT FOR ELECTRICAL CONTACTS AND CONTACT PIECE

(75) Inventors: Helmut Heinzel, Tiefenbronn (DE); Andreas Kraus, Muehlacker (DE); Evelyn Mahle-Moessner, Pforzheim (DE); Johann Wenz, Pforzheim (DE)

(73) Assignee: Doduco GmbH, Pforzheim (DE)

( * ) Notice: Subject to any disclaimer, the term of this patent is extended or adjusted under 35 U.S.C. 154(b) by 985 days.

(21) Appl. No.: 13/128,107

(22) PCT Filed: Oct. 27, 2009

(86) PCT No.: PCT/EP2009/007662

§ 371 (c)(1), (2), (4) Date: Jun. 22, 2011

(87) PCT Pub. No.: WO2010/051923

PCT Pub. Date: May 14, 2010

(65) Prior Publication Data

US 2011/0243783 A1 Oct. 6, 2011

(30) Foreign Application Priority Data

Nov. 6, 2008 (DE) ..... 10 2008 056 264

(51) Int. Cl.

*B22F 7/02* (2006.01)
*H01R 13/03* (2006.01)
*C22C 32/00* (2006.01)

(52) U.S. Cl.

CPC ..... *H01R 13/03* (2013.01); *B22F 2998/00* (2013.01); *B22F 2998/10* (2013.01); *C22C 32/0021* (2013.01)

USPC ..... 419/6; 419/11; 419/19; 419/21; 419/26; 419/28; 419/38; 419/42

(58) Field of Classification Search

CPC ..... B22F 3/04; B22F 3/20
USPC ..... 419/8, 11, 19, 42–43
See application file for complete search history.

(56) References Cited

U.S. PATENT DOCUMENTS

| | | | | |
|---|---|---|---|---|
| 2,322,709 | A * | 6/1943 | Owen | 219/130.1 |
| 3,560,170 | A | 2/1971 | Duerrwaechter et al. | |
| 3,864,827 | A * | 2/1975 | Schreiner et al. | 29/875 |
| 4,243,413 | A * | 1/1981 | Shibata | 75/234 |
| 4,456,662 | A | 6/1984 | Malikowski et al. | |
| 4,622,269 | A | 11/1986 | Leung et al. | |
| 4,681,702 | A | 7/1987 | Schreiner et al. | |
| 5,281,176 | A | 1/1994 | Yahagi et al. | |
| 5,360,673 | A * | 11/1994 | Mayer et al. | 428/546 |
| 5,445,895 | A | 8/1995 | Behrens et al. | |
| 5,846,655 | A | 12/1998 | Henning et al. | |
| 2002/0109559 | A1 * | 8/2002 | Pitschi | 333/21 R |
| 2004/0256735 | A1 * | 12/2004 | Liu | 257/777 |

* cited by examiner

*Primary Examiner* — Roy King
*Assistant Examiner* — Ngoclan T Mai
(74) *Attorney, Agent, or Firm* — Hackler Daghighian & Martino

(57) ABSTRACT

The invention relates to a method for producing a strand-like, particularly band-like semi-finished part for electrical contacts, wherein the semi-finished part has a top side intended for making the electrical contact, said top side made from a silver-based composite material in which one or multiple metal oxides or carbon are embedded, and has a carrier layer supporting the composite material made of silver or a silver-based alloy, said method having the following steps: Powder-metallurgic production of a block made from the silver-based composite material, encasing of the block made of the composite material with a powder made primarily of silver, compressing the block, encased by the metal powder, to condense the metal powder, sintering the compressed block, reshaping the sintered block by extrusion pressing, creating a partial strand with a top side made from composite material and a bottom side made from silver or a silver-based alloy.

17 Claims, No Drawings

METHOD FOR PRODUCING A SEMIFINISHED PRODUCT AND SEMIFINISHED PRODUCT FOR ELECTRICAL CONTACTS AND CONTACT PIECE

The invention relates to a method for producing a semifinished product for electrical contacts, comprising an upper face made of a silver-based composite material intended for the electrical contact-making, one or more metal oxides or carbon being embedded in the composite material, and an easy-to-solder and easy-to-weld carrier layer comprising silver or a silver alloy, on which the composite material is located.

Silver-based composite materials comprising embedded metal oxide or carbon particles cannot be welded and soldered, or only with great difficulty. For this reason, when producing semifinished products for electrical contacts, a lower face of the contact material is provided with an easy-to-solder or easy-to-weld carrier layer comprising silver or a silver alloy. Such carrier layers are typically applied to contact materials by plating on a silver strip.

The production using a single pressing technique is also known, wherein a layer comprising silver powder is applied to a layer comprising contact material powder and a semifinished product having a front made of contact material and a back made of silver is produced by subsequent pressing and sintering. The two powder layers can be pressed jointly, or first one layer comprising only one powder can be pre-pressed and subsequently the second powder can be applied and pressed. The disadvantage in the production using a single pressing technique, however, is that no strip-shaped semifinished product can be produced.

A further known possibility consists in covering a contact material block with a silver tube and then forming it by composite extrusion molding. By longitudinally dividing a composite strand produced in this way, a semifinished product having an upper face made of contact material and a lower face made of silver is obtained. The production of a suitable silver tube and fitting a contact material block in a silver tube, however, are very complex.

SUMMARY OF THE INVENTION

It is the object of the invention to show a way of how a strip-shaped semifinished product for electrical contacts can be produced cost-effectively, which comprises an upper face made of a silver-based composite material intended for electrical contact-making and a lower face made of silver or a silver alloy.

This object is achieved by a method having the characteristics of claim 1. Advantageous refinements of the invention are the subject matter of the dependent claims.

DETAILED DESCRIPTION

In a method according to the invention, first a block comprising a silver-based composite material is produced using a powder-metallurgical process, for example by mixing silver powder with metal oxide powder, pressing it, and subsequently sintering it. It is also possible, for example, to mix silver powder with a base metal powder, press it, and subsequently sinter it in an oxidizing atmosphere, whereby metal oxide particles are produced by oxidation of the base metal particles.

In a second step, the powder metallurgically produced block is covered with silver powder or powder made of a silver-base alloy, and subsequently pressed so as to compact the powder cover, preferably at pressures of 500 bar to 2500 bar. To this end, it is possible to admix base metal powder to the powder comprising silver or a silver-base alloy in order to generate a cover comprising a silver-base alloy, which is to say an alloy consisting predominantly of silver, by way of powder metallurgy.

The preferably isostatically pressed block is sintered in a further production step and subsequently worked by extrusion molding, preferably hot-worked. Thereafter at least one partial strand is produced that has an upper face comprising composite material and a lower face comprising silver or a silver-base alloy. Preferably two such partial strands are generated by dividing the strand formed by extrusion molding in the longitudinal direction thereof. It is, of course, possible to carry out additional longitudinal divisions perpendicular to the separating plane. The information that preferably two partial strands are produced should thus be interpreted to mean at least two. However, it is also possible to generate only one partial strand, by removing the silver or the silver alloy on one side of the strand formed by extrusion molding, for example by milling, so as to expose a surface comprising composite material.

After sintering, the silver or the silver alloy generally adheres with sufficient strength to the block, so that the block can be shaped so that it can be inserted in an extrusion die with precise fit. For example, an approximately cylindrical block can be produced by isostatic pressing and subsequent sintering, the lateral area of which is subjected to a turning process before extrusion molding so as to achieve an adaptation to the dimensions of an extrusion die. The block is preferably formed by extrusion molding from a cylindrical shape into a shape having a rectangular cross-section.

The extrusion molding is preferably carried out at temperatures of at least 600° C., and more particularly between 700° C. and 950° C. This measure has the advantage that advantageously high compaction is achieved by the extrusion molding. Advantageously, it can be achieved in particular that the strand has a relative density of 99.9% of the theoretically possible density.

By dividing the strand formed by extrusion molding in the longitudinal direction, a semifinished product is obtained that has a layer comprising a silver-based composite material, which forms the upper face of the semifinished product intended for contact-making, and an easy-to-solder and easy-to-weld carrier layer as the lower face.

The two flanks of the strand extending from the contact-making upper face to the easy-to-solder and easy-to-weld lower face of the strand are preferably trimmed, notably by cutting or milling. In this way, it can be ensured that during further processing of the semifinished product, or during later use of an electrical contact produced with the semifinished product, no material of the carrier layer reaches the contact surface and impairs the function thereof. The flanks of the strand formed by extrusion molding can optionally be trimmed before or after the longitudinal division of the strand.

It is preferred to reduce the thickness of the strand generated by extrusion molding by way of rolling, notably by cold rolling. In this way, a strip-shaped semifinished product is particularly advantageous to produce. It is particularly preferred for the rolling to take place after longitudinally dividing the strand. It is further preferred for the thickness of the strand to be reduced during rolling by no more than 50% of the original thickness, so as to avoid that mechanical properties of the semifinished product are disadvantageously impaired. Notably when reducing the thickness by more than 50%, there is the risk that the material becomes too hard. It is particularly preferred for the thickness of the strand to be reduced during rolling by 30 to 50% of the original thickness.

In the method preferably a composite material is used that is a silver-metal oxide composite material. The metal oxides used can be notably tin oxide and/or zinc oxide and/or indium oxide and/or cadmium oxide. It is also possible, for example, to use bismuth oxide or tungsten oxide. It is possible for the composite material used according to the invention to comprise a plurality of metal oxides. Likewise, it is possible for the composite material to contain only a single metal oxide. The metal oxide component of the composite material preferably primarily comprises tin oxide. As an alternative, or in addition to the metal oxides, the silver-based contact material that is used may also contain carbon, for example in the form of graphite.

The composite material block covered with base metal powder is preferably subjected to cold isostatic pressing. Cold isostatic pressing can be carried out without difficulty at room temperature. In general, the cold isostatic pressing can also be carried out at elevated temperatures, however it is preferred for the cold isostatic pressing to be carried out a temperature at which the base metal is at most insignificantly oxidized in the presence of atmospheric oxygen.

EMBODIMENTS

1. A cylindrical block comprising a silver-based contact material is produced by mixing silver powder and tin oxide powder, cold isostatic pressing, and subsequent sintering. This block, for example, may comprise 8 to 14 percent by weight of metal oxide, the remainder being silver.

The composite material block is covered with silver powder and then cold isostatically pressed. The isostatically pressed block is then sintered under air at 800° C. to 900° C., for example for 2 to 5 hours. The sintered block is subsequently subjected to a turning step, so that it can be inserted with precise fit in an extrusion press. Then the block is formed by extrusion molding at a temperature of 750° C. to 775° C. from the cylindrical shape thereof into a shape having a rectangular cross-section.

The flanks of the strand produced in this way are cut off and the strand is subsequently divided in the longitudinal direction. The partial strands formed in this way are subsequently cold-rolled, reducing the thickness thereof by 30 to 50%, for example by 45%. The strip-shaped semifinished product produced in this way comprises a carrier layer, the thickness of which constitutes approximately 10% to 20% of the thickness of the composite material layer, and can be used to produce electrical contact pieces by cutting sections off the semifinished product and forming them according to the requirements of a specific application.

2. A cylindrical block comprising a silver-based contact material is produced by mixing silver powder and graphite powder, by cold isostatic pressing, and subsequent sintering. This block, for example, may comprise 2 to 5 percent by weight of carbon, the remainder being silver. The composite material block is covered with powder made of silver or a silver-base alloy and sintered for several hours at 750° C. to 775° C. The sintered block can be further processed as described in the embodiment above.

The invention claimed is:

1. A method for producing a strip-shaped semifinished product for electrical contacts, wherein the semifinished product has an upper face comprising a silver-based composite material intended for the electrical contact-making, one or more metal oxides or carbon being embedded in the composite material, and an easy-to-solder or easy-to-weld carrier layer comprising silver or a silver-base alloy, which carries the composite material, comprising the following steps:

producing a block from the silver-based composite material using a powder-metallurgical process;

covering the block comprising the composite material with a powder that primarily contains silver;

isostatically pressing the block covered with the metal powder so as to compact the metal powder;

sintering the pressed block;

working the sintered block by extrusion molding; and generating a partial strand having an upper face comprising composite material and a lower face comprising silver or a silver-base alloy.

2. The method according to claim 1, wherein two partial strands are generated by dividing the strand formed by extrusion molding in the longitudinal direction thereof.

3. A method according to claim 1, wherein the composite material is a silver-metal oxide composite material.

4. A method according to claim 1, wherein the silver-based composite material contains at least one of the following oxides: tin oxide, zinc oxide, indium oxide, and cadmium oxide.

5. A method according to claim 1, wherein a mixture comprising silver powder and base metal powder is used to cover the block comprising the composite material.

6. A method according to claim 1, wherein silver powder or powder of a silver-base alloy is used to cover the block comprising the composite material.

7. A method according to claim 1, wherein the covered block is cold isostatically pressed.

8. A method according to claim 1, wherein the extrusion molding is carried out at temperatures of at least 600° C.

9. A method according to claim 1, wherein the extrusion molding is carried out at temperatures between 700° C. and 950° C.

10. A method according to claim 1, wherein the thickness of the strand generated by extrusion molding, or a partial strand, is reduced by rolling.

11. A method according to claim 1, wherein the thickness of the strand generated by extrusion molding, or a partial strand, is reduced by cold rolling.

12. The method according to claim 11, wherein the thickness is reduced by no more than 50% during rolling.

13. A method according to claim 1, wherein the strand comprises two flanks, where the two flanks of the strand extending from the contact-making upper face to the easy-to-solder and easy-to-weld lower face of the strand forming the carrier layer are trimmed.

14. A method according to claim 1, wherein an approximately cylindrical sintered block is produced, the lateral area of which is subjected to turning prior to extrusion molding.

15. A method according to claim 1, wherein the block is formed by extrusion molding from a cylindrical shape into a shape having a rectangular cross-section.

16. A method for producing a strip-shaped semifinished product for electrical contacts, wherein the semifinished product has an upper face comprising a silver-based composite material intended for the electrical contact-making, one or more metal oxides or carbon being embedded in the composite material, and an easy-to-solder or easy-to-weld carrier layer comprising silver or a silver-base alloy, which carries the composite material, comprising the following steps:

producing a block from the silver-based composite material using a powder-metallurgical process;

covering the block comprising the composite material with a powder that primarily contains silver;

cold isostatically pressing the block covered with the metal powder so as to compact the metal powder;

sintering the pressed block;

working the sintered block by extrusion molding; and generating a partial strand having an upper face comprising composite material and a lower face comprising silver or a silver-base alloy.

17. A method for producing a strip-shaped semifinished product for electrical contacts, wherein the semifinished product has an upper face comprising a silver-based composite material intended for the electrical contact-making, one or more metal oxides or carbon being embedded in the composite material, and an easy-to-solder or easy-to-weld carrier layer comprising silver or a silver-base alloy, which carries the composite material, comprising the following steps:

producing a block from the silver-based composite material using a powder-metallurgical process;

covering the block comprising the composite material with a powder that primarily contains silver;

pressing the block covered with the metal powder so as to compact the metal powder;

sintering the pressed block, wherein an approximately cylindrical sintered block is produced, the lateral area of which is subjected to turning prior to a next step of extrusion molding;

working the sintered block by the extrusion molding; and generating a partial strand having an upper face comprising composite material and a lower face comprising silver or a silver-base alloy.

* * * * *